US009601872B2

(12) United States Patent
Yan

(10) Patent No.: US 9,601,872 B2
(45) Date of Patent: Mar. 21, 2017

(54) ANTI-INTERFERENCE HIGH-DEFINITION MULTIMEDIA INTERFACE

(71) Applicant: Amphenol East Asia Electronic Technology (Shen Zhen) Co., Ltd., Shenzhen (CN)

(72) Inventor: Haixiang Yan, Shenzhen (CN)

(73) Assignee: Amphenol East Asia Electronic Technology (Shen Zhen) Co., Ltd., Shenzhen (CN)

( * ) Notice: Subject to any disclaimer, the term of this patent is extended or adjusted under 35 U.S.C. 154(b) by 0 days.

(21) Appl. No.: 14/826,855

(22) Filed: Aug. 14, 2015

(65) Prior Publication Data

US 2017/0047685 A1 Feb. 16, 2017

(51) Int. Cl.

| | |
|---|---|
| ***H01R 13/648*** | (2006.01) |
| ***H01R 13/646*** | (2011.01) |
| ***H01R 24/70*** | (2011.01) |
| ***H01R 24/78*** | (2011.01) |

(52) U.S. Cl.

CPC ..... *H01R 13/646* (2013.01); *H01R 24/70* (2013.01); *H01R 24/78* (2013.01)

(58) Field of Classification Search

CPC .. H01R 13/646; H01R 13/6581; H01R 24/70; H01R 13/6656; H01R 24/78; H01R 13/502; H01R 13/6461; G02B 6/3817

USPC ..... 439/607.27

See application file for complete search history.

(56) References Cited

U.S. PATENT DOCUMENTS

| | | | | |
|---|---|---|---|---|
| 8,308,376 | B2 * | 11/2012 | Liao | G02B 6/3817 385/88 |
| 8,562,378 | B2 * | 10/2013 | Su | H01R 13/502 439/607.55 |
| 8,591,259 | B2 * | 11/2013 | Wu | H01R 13/6581 439/607.27 |
| 9,337,589 | B2 * | 5/2016 | Wang | H01R 13/6461 |
| 2009/0318026 | A1 * | 12/2009 | Yi | H01R 13/6658 439/607.24 |

* cited by examiner

*Primary Examiner* — Jean F Duverne
(74) *Attorney, Agent, or Firm* — Maier & Maier, PLLC

(57) ABSTRACT

The present application relates to high-definition multimedia interface, particularly to a new anti-interference high-definition multimedia interface. The interface comprises a male connector and a female connector. The male connector includes a male outer plastic housing, a shield stretch rear housing and a male plastic cable clamp. The female connector includes a female outer plastic housing, an outer shield grounding housing, an inner shield grounding iron housing, a female insulator, a female signal terminal and a female plastic rear plug. The male outer plastic housing and the shield stretch rear housing together form an inner cavity after connecting to each other, in which the male terminal assembly will be received. The female outer plastic housing and the outer shield grounding housing together form an inner cavity after connecting to each other, in which the female terminal assembly is received.

6 Claims, 2 Drawing Sheets

ANTI-INTERFERENCE HIGH-DEFINITION MULTIMEDIA INTERFACE

TECHNICAL FIELD

The present application relates to high-definition multimedia interface, particularly to a new anti-interference high-definition multimedia interface.

BACKGROUND OF THE INVENTION

High-definition multimedia interface belongs to digital video/audio interface technology, which is a digital interface dedicated for video/audio transmission and could be divided into five categories, i.e., A, B, C, D and E types. At present, a problem prevalently exists with the high-definition multimedia interface of E type, making it vulnerable to interference during transmission.

SUMMARY OF THE INVENTION

The present invention aims at providing a new anti-interference high-definition multimedia interface, which renders more stable and reliable signal transmission and stronger anti-interference capacity.

In order to solve the above mentioned problem, the present application provides the following solution. A new anti-interference high-definition multimedia interface comprises a male connector and a female connector. The male connector includes a male housing assembly and a male terminal assembly. The male housing assembly includes a male outer plastic housing and a shield stretch rear housing. The female connector includes a female housing assembly and a female terminal assembly. The female housing assembly includes a female outer plastic housing and an outer shield grounding housing.

The shield stretch rear housing is capable of seamlessly fitting into the male outer plastic housing. After connecting to each other, the male outer plastic housing and the shield stretch rear housing together form an inner cavity in which the male terminal assembly will be received.

The female outer plastic housing is capable of seamlessly fitting into the outer shield grounding housing. After connecting to each other, the female outer plastic housing and the outer shield grounding housing together form an inner cavity in which the female terminal assembly is received.

In a preferred embodiment, the male terminal assembly includes a male plastic cable clamp having a plurality of teeth. Cables could be received between two individual teeth.

In a preferred embodiment, the male plastic cable clamp can be fixed to a male plastic rear plug. The male terminal assembly further includes the male plastic rear plug, a male signal terminal and a male insulator. The male plastic rear plug is connected with the male insulator to form a male inner cavity in which the male signal terminal could be inserted.

In a preferred embodiment, the male terminal assembly further includes a front shield housing in which the male plastic rear plug and the male insulator as well as the male signal terminal inserted therein are fixed.

In a preferred embodiment, the female terminal assembly includes a female insulator, a female signal terminal and a female plastic rear plug. The female plastic rear plug is connected with the female insulator to form a female inner cavity.

In a preferred embodiment, the female signal terminal could be inserted into the female inner cavity. The female terminal assembly further includes an inner shield grounding iron housing in which the female plastic rear plug and the female insulator as well as the female signal terminal inserted therein are fixed.

With the above mentioned technical solutions, the present invention could achieve the following advantageous effects. Firstly, compared with the technical solutions already disclosed, thanks to employing the plastic rear plugs of the male and female connectors to connect the two signal terminals respectively, the present invention can effectively fix the signal terminals so as to avoid the bad influence of their displacement and detachment during operation, thereby ensure high accuracy of signal transmission. Meanwhile, the shield stretch rear housing of the male connector is capable of seamlessly fitting into the male outer plastic housing, which renders sound shielding effect and could further enhance the anti-interference capacity of the high-definition multimedia interface.

DETAILED DESCRIPTION OF THE EMBODIMENTS

The present invention will now be described in detail with reference to the specific embodiments, taken in conjunction with drawings. However, the description and the drawings are not intended to limit the scope of the present application.

Figure 1:
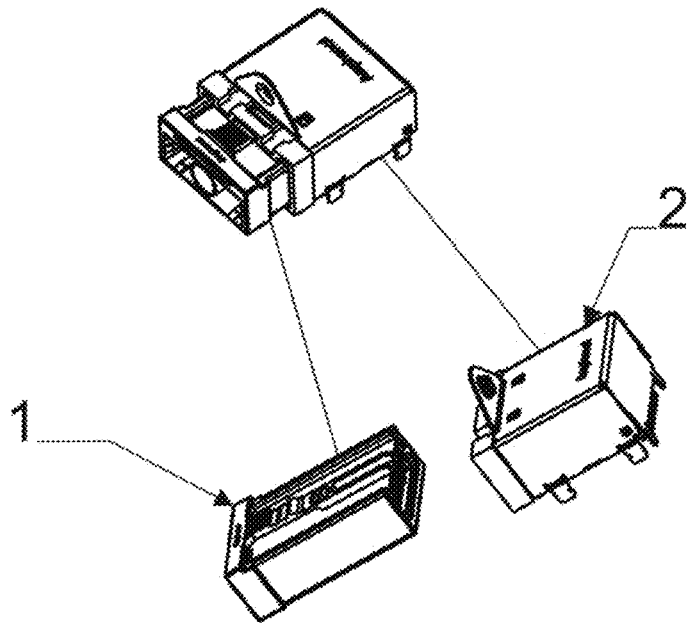
FIG. 1 is a general assembly view of the new anti-interference high-definition multimedia interface.
Figure 2:
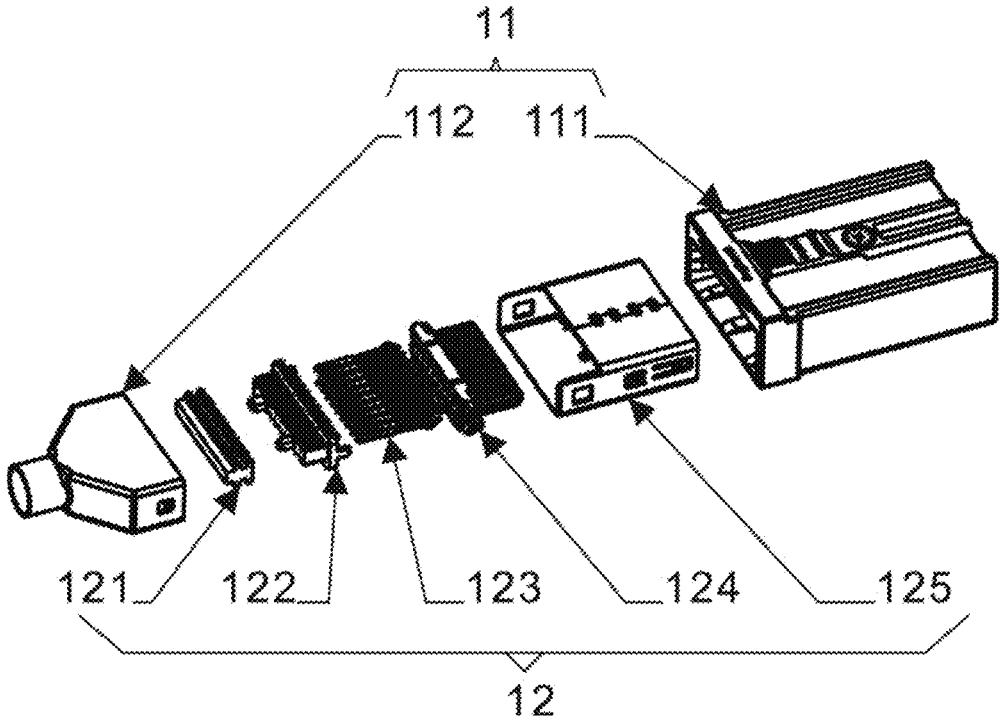
FIG. 2 shows the male connector of the interface.
Figure 3:
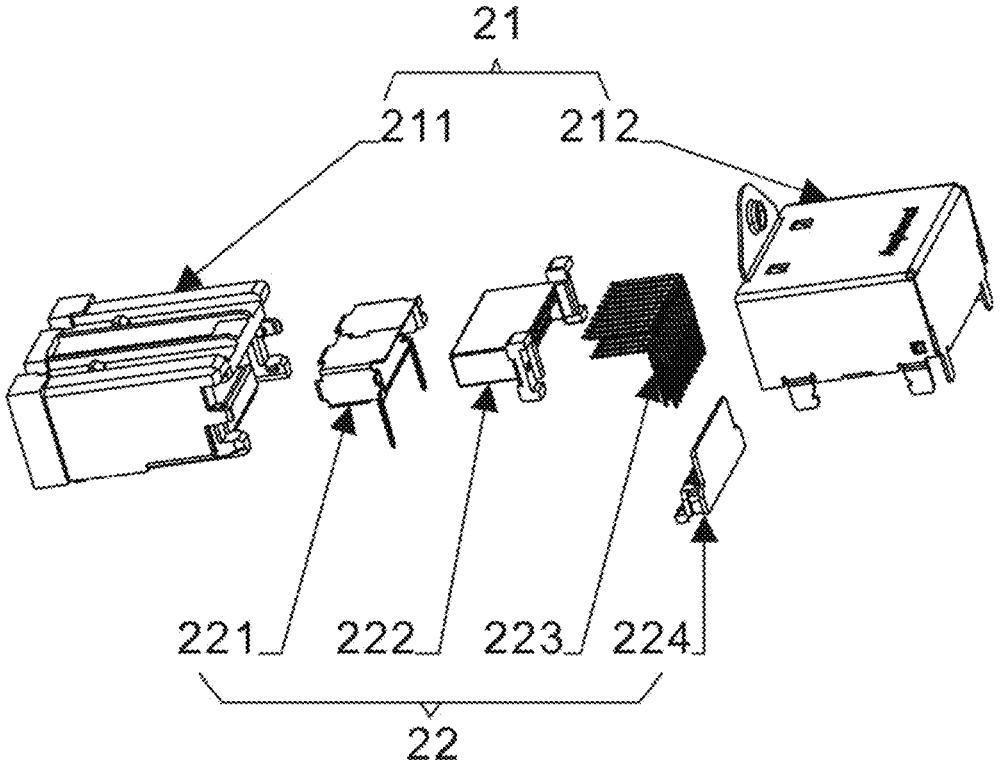
FIG. 3 shows the female connector of the interface.

As shown in FIG. 1 to FIG. 3, a new anti-interference high-definition multimedia interface specifically comprises a male connector 1 and a female connector 2. The male connector 1 includes a male housing assembly 11 and a male terminal assembly 12. The male housing assembly 11 includes a male outer plastic housing 111 and a shield stretch rear housing 112. The female connector 2 includes a female housing assembly 21 and a female terminal assembly 22. The female housing assembly 21 includes a female outer plastic housing 211 and an outer shield grounding housing 212.

As shown in FIG. 2, the shield stretch rear housing 112 is capable of seamlessly fitting into the male outer plastic housing 111. After connecting to each other, the male outer plastic housing 111 and the shield stretch rear housing 112 together form an inner cavity in which the male terminal assembly 12 will be received.

As shown in FIG. 2, on the basis of the above described embodiments, the male terminal assembly 12 includes a male plastic cable clamp 121 having a plurality of teeth. Cables could be received between two individual teeth, and the male plastic cable clamp 121 can be fixed to a male plastic rear plug 122.

As shown in FIG. 2, on the basis of the above described embodiments, the male terminal assembly 12 further includes the male plastic rear plug 122, a male signal terminal 123 and a male insulator 124. The male plastic rear plug 122 is connected with the male insulator 124 to form a male inner cavity, in which the male signal terminal 123 could be inserted.

As shown in FIG. 2, on the basis of the above described embodiments, the male terminal assembly 12 further includes a front shield housing 125 in which the male plastic rear plug 122 and the male insulator 124 as well as the male signal terminal 123 inserted therein are fixed.

As shown in FIG. 3, on the basis of the above described embodiments, the female outer plastic housing 211 is capable of seamlessly fitting into the outer shield grounding housing 212. After connecting to each other, the female outer plastic housing 211 and the outer shield grounding housing 212 together form an inner cavity in which the female terminal assembly 22 is received.

As shown in FIG. 3, on the basis of the above described embodiments, the female terminal assembly 22 includes a female insulator 222, a female signal terminal 223 and a female plastic rear plug 224. The female plastic rear plug 224 is connected with the female insulator 222 to form a female inner cavity in which the female signal terminal 223 could be inserted.

As shown in FIG. 3, on the basis of the above described embodiments, the female terminal assembly 22 further includes an inner shield grounding iron housing 221 in which the female plastic rear plug 224 and the female insulator 222 as well as the female signal terminal 223 inserted therein are fixed.

From the common knowledge in the art, the present invention can be realized by other embodiments which do not depart from the spirit and essential features of the application. Therefore, under any circumstance, the above disclosed embodiments are intended for the purpose of illustration only, and are not intended to be exhaustive. The modifications and variations within the scope of the application or its equivalents will fall within the protection scope of the invention.

The invention claimed is:

1. An anti-interference high-definition multimedia interface comprising:

a male connector and a female connector, wherein the male connector includes a male housing assembly and a male terminal assembly, the male housing assembly includes a male outer plastic housing and a shield stretch rear housing, the female connector includes a female housing assembly and a female terminal assembly, and the female housing assembly includes a female outer plastic housing and an outer shield grounding housing, wherein the shield stretch rear housing is capable of seamlessly fitting into the male outer plastic housing, the male outer plastic housing and the shield stretch rear housing together form an inner cavity after connecting to each other, in which the male terminal assembly could be received; and wherein the female outer plastic housing is capable of seamlessly fitting into the outer shield grounding housing, the female outer plastic housing and the outer shield grounding housing together form an inner cavity after connecting to each other, in which the female terminal assembly could be received.

2. The anti-interference high-definition multimedia interface according to claim 1, wherein the male terminal assembly includes a male plastic cable clamp having a plurality of teeth, cables that could be received between two individual teeth, among the plurality of teeth, and the male plastic cable clamp can be fixed to a male plastic rear plug.

3. The anti-interference high-definition multimedia interface according to claim 2, wherein the male terminal assembly further includes the male plastic rear plug, a male signal terminal and a male insulator, and the male plastic rear plug is connected with the male insulator to form a male inner cavity in which the male signal terminal could be inserted.

4. The anti-interference high-definition multimedia interface according to claim 3, wherein the male terminal assembly further includes a front shield housing within which the male plastic rear plug and the male insulator as well as the male signal terminal inserted therein are fixed.

5. The anti-interference high-definition multimedia interface according to claim 1, wherein the female terminal assembly includes a female insulator, a female signal terminal and a female plastic rear plug, and the female plastic rear plug is connected with the female insulator to form a female inner cavity within which the female signal terminal could be inserted.

6. The anti-interference high-definition multimedia interface according to claim 1, wherein the female terminal assembly further includes an inner shield grounding iron housing in which the female plastic rear plug and the female insulator as well as the female signal terminal inserted therein are fixed.

* * * * *